United States Patent [19]

Howie, Jr.

[11] 4,012,806

[45] Mar. 22, 1977

[54] KNOB WITH DEFORMABLE WEB

[75] Inventor: Robert K. Howie, Jr., Decatur, Ill.

[73] Assignee: The Grigoleit Company, Decatur, Ill.

[22] Filed: Apr. 30, 1975

[21] Appl. No.: 573,260

[52] U.S. Cl. ..... 16/121; 74/553
[51] Int. Cl.[2] ..... E05B 1/00
[58] Field of Search ..... 16/121, 118; 74/553

[56] References Cited

UNITED STATES PATENTS

| | | | |
|---|---|---|---|
| 1,477,785 | 12/1923 | Szukalski, Jr. | 74/553 |
| 1,537,227 | 5/1925 | DeWitt | 74/553 X |
| 1,552,052 | 9/1925 | Danielson et al. | 74/553 |
| 3,176,541 | 4/1965 | Keeling, Sr. et al. | 74/553 |

FOREIGN PATENTS OR APPLICATIONS

| | | | |
|---|---|---|---|
| 1,067,132 | 1/1954 | France | 74/553 |
| 2,103,402 | 8/1972 | Germany | 16/118 |

*Primary Examiner*—Andrew V. Kundrat
*Attorney, Agent, or Firm*—Kinzer, Plyer, Dorn & McEachran

[57] ABSTRACT

A knob for mounting on the end of a shaft, especially a shaft of the type which extends through an opening in a panel and must be moved axially and rotated during operation thereof. The knob includes a hub, a shaft receiving socket formed in the hub and a web extending from the hub and terminating in a rim. The web is formed so as to be sufficiently flexible and deformable to permit the hub and the rim to move axially relative to each other. An annular dial may cover most of the flexible web. The knob and web may be formed in one piece, preferably of plastic or they may be separate pieces fastened together. When separate pieces, the knob may be plastic and the web may be spring steel.

10 Claims, 14 Drawing Figures fig.1.
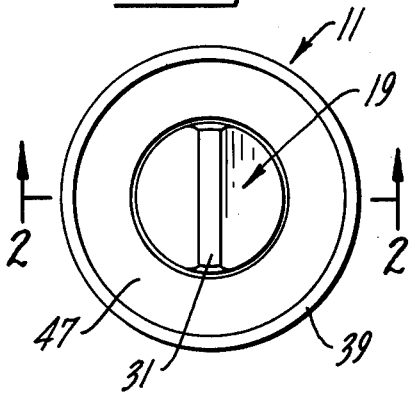
fig.2.
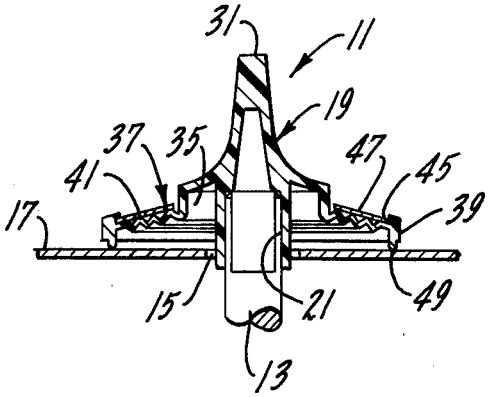
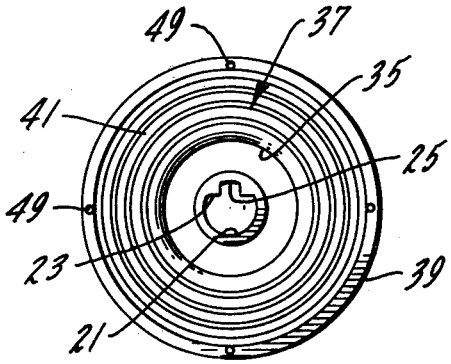
fig.4.
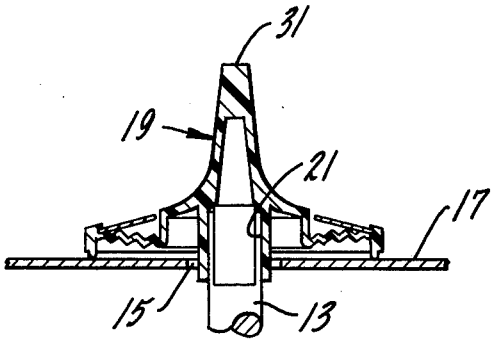
fig.3.
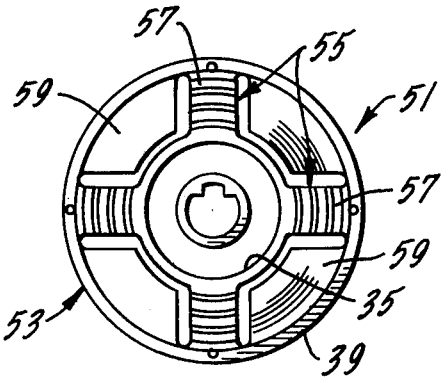
fig.5.
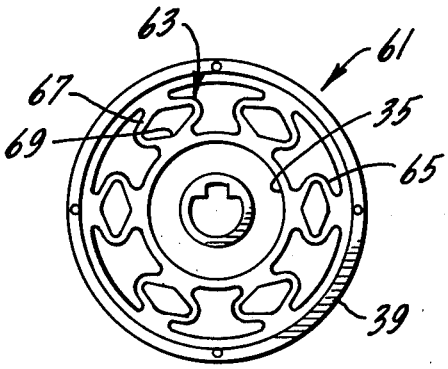
fig.6.

fig.7.
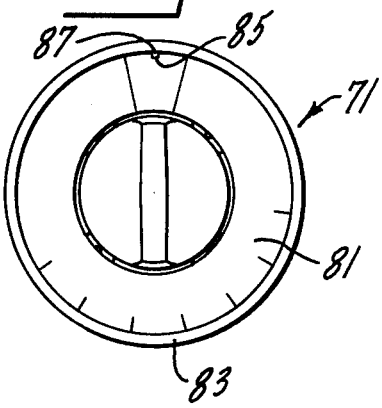
fig.8.
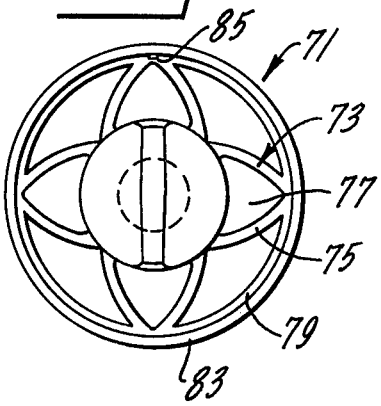
fig.9.
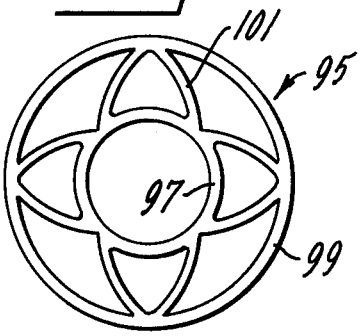
fig.10.
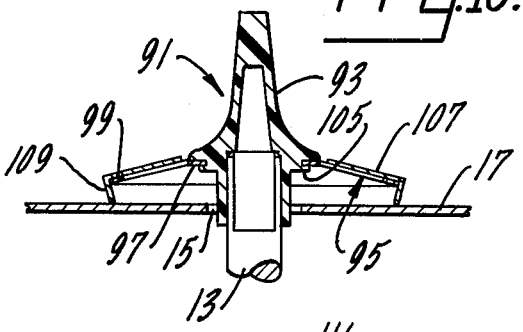
fig.11.
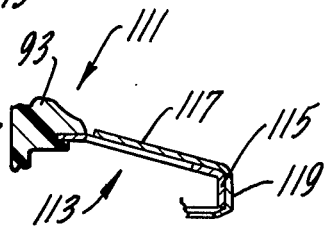
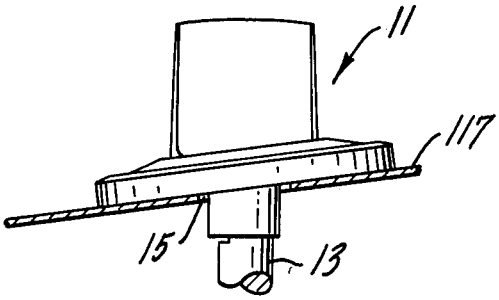
fig.12.
fig.13.
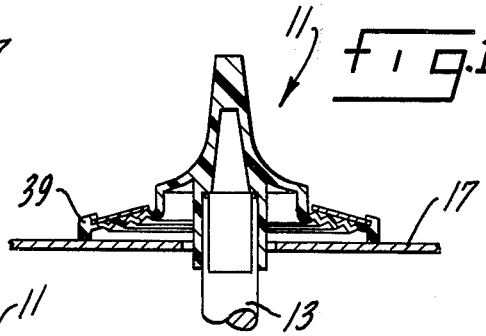
fig.14.
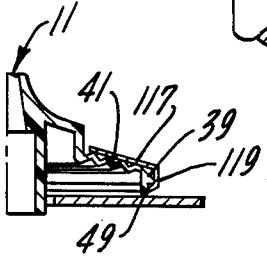

KNOB WITH DEFORMABLE WEB

SUMMARY OF THE INVENTION

This invention is concerned with a knob for mounting on the end of a shaft, especially a shaft of the type which extends through an opening in a panel and must be both moved axially and rotated during operation.

An object of this invention is a knob having a blade or hub which can be moved axially relative to the rim and which has no more parts than a conventional rigid knob.

Another object is a knob of the type described which can be formed in two pieces, at least one of which may be molded of plastic.

Another object is a knob having a web of a resilient spring steel with a hub or blade of molded plastic fastened thereto.

Another object is a knob having a rim which can maintain contact completely around its periphery with a panel face which is tilted relative to the knob shaft extending through the panel.

Another object is a knob which can also be used on a non-axially moving shaft to provide controlled clearance between the knob and a panel face.

Another object is a knob having a hub or blade which can be moved axially inwardly relative to a rim and which will return to its extended position relative to the rim upon the release of force applied to the blade.

Another object is a knob having a hub or blade which can be moved axially inwardly towards its rim and which will not return from said inward position without the application of force.

Another object is a knob which will seal the opening in a panel face around its shaft.

Other objects may be found in the following specification, claims and drawings.

BRIEF DESCRIPTION OF THE DRAWINGS

The invention is illustrated more or less diagramatically in the following drawings wherein:

FIG. 1 is a top plan view of a knob embodying the novel features of this invention;

FIG. 2 is a cross-sectional view taken along line 2—2 of FIG. 1;

FIG. 3 is a cross-sectional view similar to FIG. 2, but showing the knob in its operative position;

FIG. 4 is a bottom plan view of the knob of FIG. 1;

FIG. 5 is a bottom plan view of a modified form of knob;

FIG. 6 is a bottom plan view of another modified form of knob;

FIG. 7 is a top plan view of still another modified form of knob;

FIG. 8 is a top plan view of the knob of FIG. 7 with the dial removed;

FIG. 9 is a top plan view of a modified web formed of spring steel;

FIG. 10 is a longitudinal cross-sectional view of a knob incorporating the web of FIG. 9;

FIG. 11 is a partial longitudinal cross-sectional view showing a modified form of spring steel web;

FIG. 12 is a side elevational view of a knob of this invention mounted on a shaft extending through a panel face which is inclined to the axis of the shaft;

FIG. 13 shows the knob of this invention sealing the opening in the panel around its shaft; and FIG. 14 is a partial cross-sectional view showing another form of a dial attached to a knob of this invention.

DESCRIPTION OF THE PREFERRED EMBODIMENTS

A knob 11 embodying the novel features of this invention is shown in FIG. 1 through 4 of the drawings. This knob is intended to be mounted on a shaft 13 which extends through an opening 15 in a front wall 17 of an appliance or control panel or the like. The knob includes a hub or blade 19 in which is formed a shaft receiving socket 21. The socket may have a flat wall 23 in which is formed a groove 25 to receive a key or an indexing portion formed on the shaft, neither of which is shown in the drawings for clarity of illustration.

The hub 19 is shown as a tapered structure having a flat end 31 but it should be understood that the shape of the hub may vary considerably as design and operational considerations dictate. The shaft socket 21 is surrounded by a cup like portion 35 formed integrally with and extending from the base of the hub 19. This cup opens in the direction of the shaft 13. A web 37 is formed integrally with the cup portion 35 and extends radially outwardly therefrom terminating in a rim 39. The web 37 is formed with concentric accordion-like pleats 41 which give the web its flexibility and deformability.

The rim 39 which is relatively rigid compared to the web 37 has a radially inwardly facing and upwardly inclined slot 45 which receives and supports one edge of a dial 47. The dial is supported in position over the flexible web 37. The dial 47 may be formed of metal, preferably aluminum, or plastic and may be marked with suitable indicia. Feet 49 are located circumferentially around the bottom of the rim 39 to control clearance and to reduce frictional drag between the knob 11 and the front wall 17 of the appliance or control panel.

A modified form of knob 51 is shown in FIG. 5 of the drawings. In this modification, the web 53 is formed in radially extending segments or spokes 55 with the spokes extending from the cup portion 35 of the hub to the rim 39. Each radially extending spoke portion is formed with concentric accordion-like pleats 57 which give flexibility and deformability to the web. Arcuate members 59 extend radially inwardly from the rim 39 with the members being located between the spokes 55.

Another modified form of knob 61 is shown in FIG. 6 of the drawings. In this embodiment of the invention, the web 63 is formed of radially extending segments or spokes 65. The spokes extend between the cup portion 35 of the hub 19 and the rim 39. Each of the spokes has a center portion 67 which bulges circumferentially and a cut away portion 69 in the bulge to provide the flexibility and deformability of the web.

Still another modified form of knob 71 is shown in FIGS. 7 and 8 of the drawings. The knob 71 includes a web 73 formed in radially extending, somewhat triangular like segments 75, the center portion 77 of each being removed to form each segment in the shape of parabola. The blade, web and rim 79 are integrally molded of a suitable plastic. A raised flange 83, which is located around the outer periphery of the rim 79, engages and holds the outer edge of the dial 81, which is formed of metal, preferably aluminum. A tab 85 formed integrally with the rim on the inner diameter thereof fits in a notch 87 formed in the outer edge of the dial to orient the dial relative to the blade or hub.

Another modified knob is shown in FIGS. 9 and 10 of the drawings. In this modification, the knob 91 has a molded plastic blade or hub 93. The web 95 is dish shaped and is stamped or otherwise formed from a resilient spring steel. The web includes an inner collar 97 and an outer rim 99 connected by a plurality of parabolic shaped radial segments 101. Circumferentially spaced fingers 105 formed on the lower portion of the hub fit underneath the inner collar 97 of the web when the web is assembled to the hub. The fingers are melted so that they spread under the collar 97 and hold the web securely to the blade or hub 93. A dial 107, preferably of aluminum, fits over the top of the web and has a downwardly and inwardly extending skirt 109, which clamps the dial to the web and closes any gap between the web and the face of the panel 17. A notch (not shown) is formed in the inner diameter of the dial. The notch receives a tab (not shown) formed on the blade so that the tab can ride up and down in the notch as the blade moves relative to the dial to retain the dial and blade in alignment.

Yet another modified form of knob 111 is shown in FIG. 11 of the drawings. This knob has a blade or hub 93 to which is attached the inner collar of a web 113 in the same manner as the web 95 is attached to the knob 91. In this embodiment, the web 113 includes a downwardly extending peripheral skirt 115 which forms the outer rim of the knob. A dial 117, preferably formed of aluminum, fits over the web and has a skirt 119 which is bent downwardly and inwardly to fit under the bottom edge of the web skirt 115, thereby locking the dial to the knob.

FIG. 13 shows a knob 11 from which the feet 49 have been removed so that the rim 39 contacts the panel face 17 to completely seal the opening 15 around the shaft 13.

FIG. 14 shows a knob similar to knob 11 on which is mounted an aluminum dial similar to dial 117. The dial extends over the corrugated web 41 and its skirt 119 is bent under the outer edge of the rim 39 to hold the dial in position.

The use, operation, and function of this invention are as follows:

The knobs of this invention are intended for use on shafts which must be moved axially and rotated in order to be operated and may also be used on shafts which do not move axially. These knobs are intended to replace the rigid knobs that have been used for many years on conventional stoves, ovens, and heating devices. The rigid knobs are unsatisfactory for use on shafts that must be both moved axially and rotated to be operated. This is because a rather large gap must be provided between the rigid knob and the front wall of the appliance or control panel to allow for the axial movement of the knob as the shaft moves axially. The gap between the knob and the front wall of the appliance or control panel is unsightly and therefore, esthetically unacceptable. The knobs of this invention may be installed with the minimum clearances previously provided for rigid knobs on shafts that do not move axially while still allowing axial movement and rotation of the shafts.

The knobs shown and described herein may also be used on shafts that do not move axially. They are particularly useful on a shaft of the type that extends through a panel that is inclined to the axis of the shaft. A shaft of this type is shown in FIG. 12. A flexible knob of this invention will maintain its rim in contact with the panel uniformly around the entire periphery of the knob. Thus, the use of a knob of the type shown will permit use of panels that extend other than at right angles to the shafts, a use that was not practical previously.

The advantages of this invention are obtained by providing flexibility and deformability between the rim of the knob and the hub or blade portion. This flexibility and deformability is provided by the novel construction of the web connecting the rim and the hub. As another advantage of this invention, the knob is constructed so that the dial 47 conceals and protects the deformable web of the knob.

FIG. 2 shows the knob 11 positioned on the shaft 14 with the shaft in its axially outward position. When the shaft is in this position, the valve or switch element controlled by the shaft will be in its off condition. The accordion-like web 37 is in its undeformed condition and is contacting the underside of the dial 47. The rim 39 is positioned in close proximity to the front face 17 of the appliance or control panel. The rim is spaced from the front face of the panel a distance which is equal to the height of the feet 49, which will normally be approximately 1/16 of an inch, plus any additional gap that may be required by manufacturing or operating considerations.

When it is desired to operate the shaft 13, the user takes hold of the blade portion 19 of the knob and pushes it inwardly. Upon inward movement of the blade, the web 37 is deformed, moving the web away from the dial 47 and towards the front wall 17 of the appliance. The rim 39 does not move during movement of the blade and web. With the shaft 13 moved axially to its inward position, which is shown in FIG. 3, it is possible to rotate the knob 11 to actuate whatever valve or device is controlled by the shaft 13. The feet 49 maintain the rim 39 of the knob spaced from the front wall 17 of the appliance to reduce rotational friction between the knob and the front wall to a minimum.

The knob 11 may be constructed so that after the shaft is operated, the knob will remain in the deformed condition shown in FIG. 3 until a counter force is applied to return it to its original formed condition. Alternately, the knob may be constructed so that it will automatically return to its original condition when the operating force is removed. If the knob is intended to automatically return to its original condition upon the release of operating force, the amount of distortion of the web is controlled so that the web cannot be moved to an "over-center" position which might prevent the knob from returning to its original condition when operating force is removed. the amount of distortion of the web can be regulated by stops built into the valve or switch controlled by the shaft. Alternately, stops may be built into the cup portion 35 of the blade 19. These stops would engage the panel 17 to limit distortion of the web.

The webs 55, 63 and 73 of the knobs 51, 61 and 71 function in the same manner as the web 37 of the knob 11. These knobs may be injection molded from suitable plastics having the desired characteristics of flexibility and resiliency. Dials, such as dial 81, may be provided to extend over and cover the webs 55, 63 and 73. The dials provide a surface on which to place indicia showing such data as operating temperatures, etc. The dials also function to prevent dirt, grease, etc. from collecting on the webs.

The metal web 95 of knob 91 functions in the same manner as the plastic webs 41, 55, 63 and 73. The skirt 109 of the dial 107 closes the gap between the knob 91 and the panel face 17. The skirt 109 also functions to maintain the rim 99 in its spaced relation to the panel face 17.

FIG. 12 shows a knob 11 mounted on a shaft 13 which extends through a panel face 117 which is inclined to the axis of the shaft 13. The flexibility and resiliency of the web permits the rim of the knob to remain in contact with the panel face 17 throughout the entire periphery of the rim, thus eliminating an unsightly gap which normally occurs between a rigid knob and an inclined panel. A rigid knob could not contact the panel face throughout the entire periphery of its rim without interfering with the rotation of the shaft.

The knob 11 shown in FIG. 13 as adapted for use with a counter top control panel. In a counter top control panel the shaft 13 extends vertically through an opening 15 in the control panel 17. It is desirable that the knob function to prevent spills of food and liquid from flowing through the opening 15 onto the valve or switch mechanism controlled by the shaft 15. The feet 49 are removed from the rim of the knob thereby permitting the bottom of the rim 39 to tightly contact the face of the control panel 17. The flexibility of the web 41 permits depression and rotation of the shaft while maintaining the rim 39 in contact with the panel face. The imperforate web 41 and the tightly fitting rim 39 will prevent liquids and solids from entering the opening 15. The knob shown in FIG. 14 can also function to seal an opening surrounding the control shaft.

I claim:

1. A knob for mounting on the end of shaft, said knob including:

a hub having an operating handle portion and a shaft receiving socket, a web extending from said hub and terminating in a rim, said web being sufficiently deformable to permit said operating handle portion and said shaft receiving socket to be moved axially relative to said rim, and an annular dial supported cantileverly on said rim and extending over substantially all of said deformable web.

2. The knob of claim 1 in which said hub, web and rim are integral.

3. The knob of claim 1 in which said hub is a separate piece fastened to said web.

4. The knob of claim 1 in which said hub is a separate plastic piece fastened to said web which is a resilient metal.

5. The knob of claim 1 in which said web remains in its deformed position after hub is moved axially relative to said rim.

6. The knob of claim 1 in which said web returns to its undeformed position after deforming force is released.

7. A knob for mounting on the end of a shaft, said knob including:

a hub having an operating handle portion and a shaft receiving socket, a web extending from said hub and terminating in a rim, said web formed of a plurality of radially extending segments which are sufficiently deformable to permit said handle portion and said shaft receiving socket to be moved axially relative to said rim, each of said web segments having a central portion thereof removed.

8. The knob of claim 7 in which means are formed as part of said rim to support an annular dial positioned over said web.

9. The knob of claim 8 in which a plurality of feet are spaced around the periphery of said rim with the feet being located on the opposite side of said web from said dial.

10. The knob of claim 8 in which said annular dial covers substantially all of the deformable web.

* * * * *